US010975756B2

(12) United States Patent
Lee

(10) Patent No.: US 10,975,756 B2
(45) Date of Patent: Apr. 13, 2021

(54) THERMOSTAT FOR AN ENGINE COOLING SYSTEM

(71) Applicants: HYUNDAI MOTOR COMPANY, Seoul (KR); KIA MOTORS CORPORATION, Seoul (KR)

(72) Inventor: Hyo-Jo Lee, Suwon-si (KR)

(73) Assignees: HYUNDAI MOTOR COMPANY, Seoul (KR); KIA MOTORS CORPORATION, Seoul (KR)

( * ) Notice: Subject to any disclaimer, the term of this patent is extended or adjusted under 35 U.S.C. 154(b) by 0 days.

(21) Appl. No.: 16/671,845

(22) Filed: Nov. 1, 2019

(65) Prior Publication Data

US 2020/0191043 A1 Jun. 18, 2020

(30) Foreign Application Priority Data

Dec. 14, 2018 (KR) ..... 10-2018-0161865

(51) Int. Cl.
*F01P 7/16* (2006.01)
*F01P 7/14* (2006.01)

(52) U.S. Cl.
CPC ..... *F01P 7/16* (2013.01); *F01P 2007/146* (2013.01); *F01P 2025/30* (2013.01); *F01P 2070/04* (2013.01)

(58) Field of Classification Search
CPC .... F01P 7/16; F01P 2007/146; F01P 2025/30; F01P 2070/04
USPC ..... 123/41.1
See application file for complete search history.

(56) References Cited

U.S. PATENT DOCUMENTS

| | | | | |
|---|---|---|---|---|
| 8,973,537 | B2 | 3/2015 | Lee | |
| 2005/0183676 | A1* | 8/2005 | Takano | F01P 7/16 123/41.1 |
| 2009/0205590 | A1* | 8/2009 | Vetrovec | F28F 1/40 123/41.14 |
| 2010/0181516 | A1* | 7/2010 | Palanchon | G05D 23/1333 251/324 |
| 2013/0263800 | A1* | 10/2013 | Lee | F01P 7/16 123/41.08 |
| 2014/0182522 | A1 | 7/2014 | Lee | |
| 2014/0345711 | A1* | 11/2014 | Ueno | F16K 1/36 137/468 |
| 2017/0276056 | A1* | 9/2017 | Spenny | G05D 23/022 |

FOREIGN PATENT DOCUMENTS

KR 101371492 B1 3/2014

* cited by examiner

*Primary Examiner* — Joseph J Dallo
*Assistant Examiner* — Yi-Kai Wang
(74) *Attorney, Agent, or Firm* — Lempia Summerfield Katz LLC

(57) ABSTRACT

A thermostat for an engine cooling system is arranged between an engine and a radiator. The thermostat may include: a housing having a coolant inlet through which inflow coolant flows in from the engine and a radiator side outlet; a main valve provided in the housing and coupled to one side of a wax to open and close the radiator side outlet by a change in volume of the wax; and a heating unit coupled to the other side of the wax to supply heat to the wax.

8 Claims, 3 Drawing Sheets

THERMOSTAT FOR AN ENGINE COOLING SYSTEM

CROSS-REFERENCE TO RELATED APPLICATION

This application claims priority to Korean Patent Application No. 10-2018-0161865, filed on Dec. 14, 2018, the disclosure of which is incorporated herein by reference in its entirety.

BACKGROUND

Field of the Disclosure

Embodiments of the present disclosure relate to a thermostat constituted in an engine cooling system to perform valve opening and closing in response to a temperature of coolant.

Description of the Related Art

A thermostat is applied to an engine cooling system as shown in FIG. 1 such that valve opening or closing thereof is controlled in response to a preset temperature of coolant.

In other words, the thermostat controls a bypass flow rate of the coolant circulating into an engine and a flow rate of the coolant in a radiator.

A mechanical thermostat among such thermostats cannot perform variable control while considering conditions of the engine and environmental factors whereas an electronic thermostat can control the flow rate of the coolant by controlling valve opening or closing in response to operating conditions such as a load of the engine and the environmental factors.

In other words, the electronic thermostat, under high load condition, controls the temperature of the coolant such that no problem in durability of the engine occurs whereas, under low load condition, it controls the temperature of the coolant to be high in consideration of fuel efficiency and performance of the engine.

The electronic thermostat is provided with a separate heater for controlling a valve opening temperature so that a main valve is configured to be operated to open or close a coolant outlet. This is done by a change in volume of internal wax in the thermostat in response to a temperature of the heater.

However, flow resistance is generated since the conventional electronic thermostat is complicated in terms of structure and is configured such that the heater is provided at the coolant outlet side upstream of the main valve. This may cause the flow rate of the coolant to be decreased.

FIG. 2 shows reduction of the flow rate in the conventional electronic thermostat. As can be seen from this figure, the flow rate of the coolant in the radiator, "Rad", is decreased by about 5% due to flow resistance caused by the heater of the thermostat.

Moreover, the conventional electronic thermostat has an unfavorable structure in which an overall length thereof is extended because the heater is coupled to the wax from a top portion of the main valve of the thermostat. In addition, since the heater is arranged on the top portion of the main valve where the temperature of the coolant is comparatively high, the structure of the electronic thermostat is liable to cause problems such as leakage of the coolant, vibration, and deterioration of durability as the thermostat is opened and closed repeatedly.

The above information disclosed in this Background section is only to assist in understanding the background of the disclosure and it may therefore contain information that does not form the prior art that is already known to those who have ordinary skill in the art.

SUMMARY

The present disclosure is made to solve the above-described problems associated with the prior art. An object of the present disclosure is to provide a thermostat for an engine cooling system, where the thermostat is configured such that a flow rate of coolant is not decreased by flow resistance of a heater for controlling valve opening or closing.

Other objects and advantages of the present disclosure can be understood by the following description and can become apparent with reference to the embodiments of the present disclosure. Also, it should be evident to those having ordinary skill in the art to which the present disclosure pertains that the objects and advantages of the present disclosure can be realized by the aspects of the disclosure as claimed and combinations thereof.

In accordance with one aspect of the present disclosure, a thermostat for an engine cooling system is arranged between an engine and a radiator. The thermostat comprises: a housing having a coolant inlet through which coolant flows in from the engine and an outlet formed at a radiator side (hereinafter, simply referred to as "radiator side outlet"); a main valve provided in the housing and coupled to one side of a wax to open and close the radiator side outlet by a change in a volume of the wax; and a heating unit coupled to the other side of the wax to supply heat to the wax.

In addition, the thermostat may further comprise a sensor arranged at a side of the coolant inlet to detect a temperature of inflow coolant.

Further, the heating unit may comprise a heater for supplying heat to the wax and a connector connected to the heater to control the heater. The connector may be provided outside the housing.

Further, an O-ring may be installed between the housing and the connector.

Further, a bypass outlet may be formed in the housing to circulate the coolant introduced through the coolant inlet to the engine. The thermostat may further comprise a bypass valve provided in the housing to open and close the bypass outlet by a change in the volume of the wax.

The bypass valve may be arranged at the other side of the wax.

In addition, one side of the heater may be coupled to the wax through the bypass valve.

According to the thermostat for an engine cooling system as disclosed in the present disclosure, flow resistance by the heater is not generated because the heater is not arranged at the coolant outlet side. The flow rate of the coolant can thus be prevented from being decreased.

Moreover, the thermostat can be constructed in a relatively simple structure rather than a structure having an extended length, as in the prior art. The thermostat structure makes it possible to avoid problems such as leakage of coolant, vibration, and deterioration of durability in spite of repeated operation of the thermostat.

It is to be understood that both the foregoing general description and the following detailed description of the present disclosure are by way of example and explanatory and are intended to provide further explanation of the disclosure as claimed.

BRIEF DESCRIPTION OF THE DRAWINGS

The above and other objects, features, and other advantages of the present disclosure will be more clearly understood from the following detailed description taken in conjunction with the accompanying drawings, in which.

DESCRIPTION OF SPECIFIC EMBODIMENTS

In order to fully understand the present disclosure, operational advantages of the present disclosure, and objects achieved by implementing the present disclosure, one should refer to the accompanying drawings exemplifying embodiments of the present disclosure and contents described in the accompanying drawings.

In describing the embodiments, detailed description of technology known in the art or iterative description may be presented in short or may be omitted to avoid obscuring the subject matter of the present disclosure.

Figure 1:
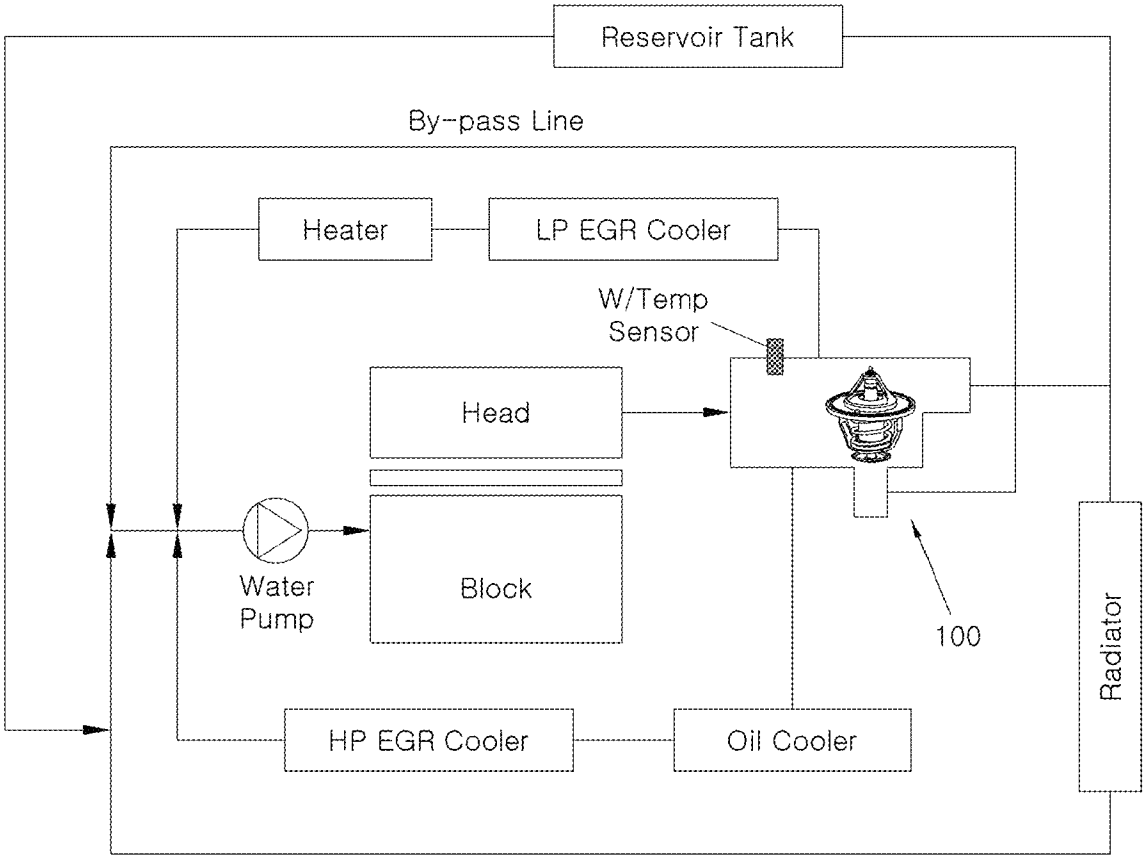
FIG. 1 shows an example of an engine cooling system.
Figure 2:
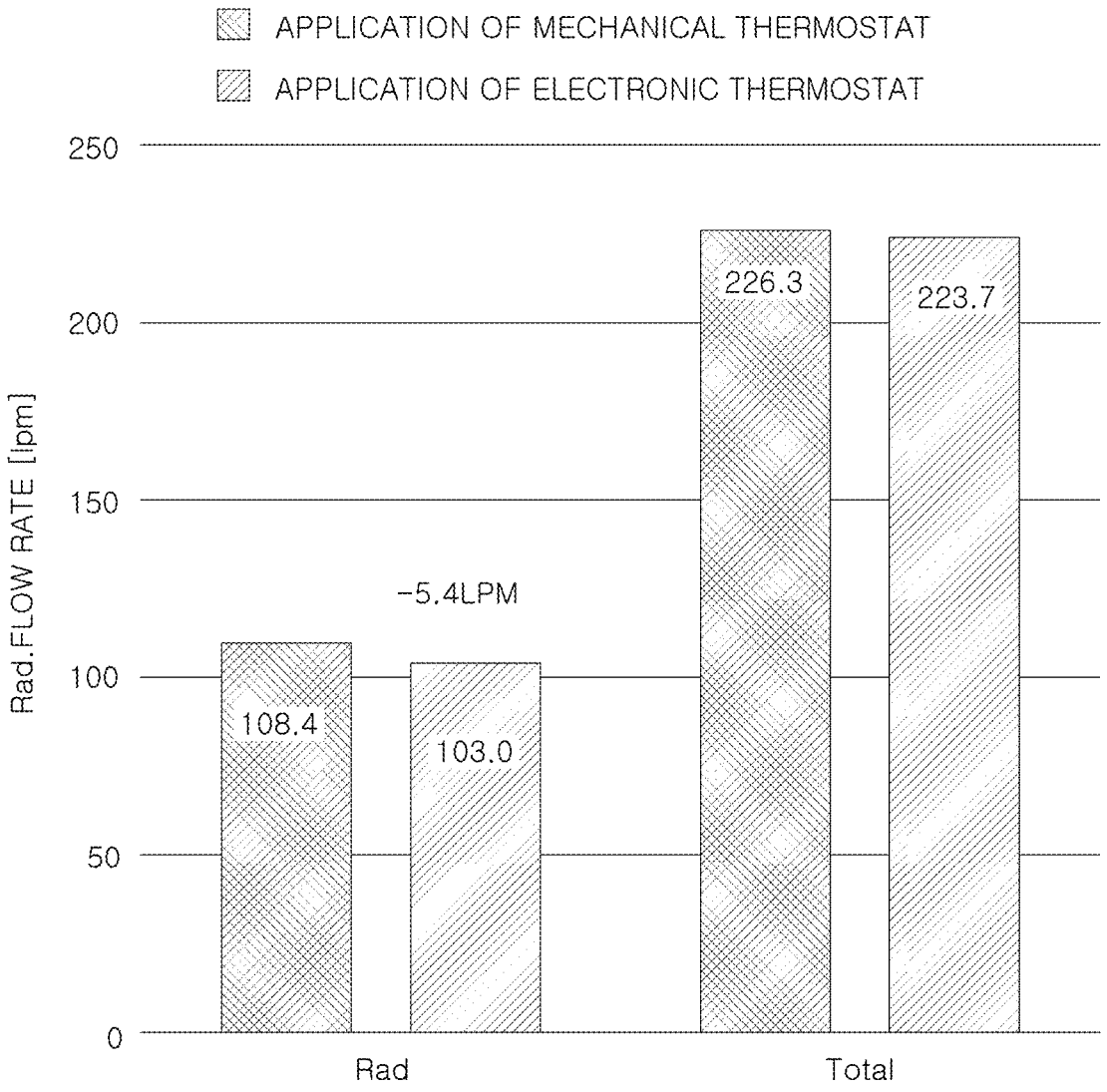
FIG.2 (Prior Art)
FIG. 2 is a graph showing reduction of a flow rate of a coolant in a conventional electronic thermostat.
Figure 3:
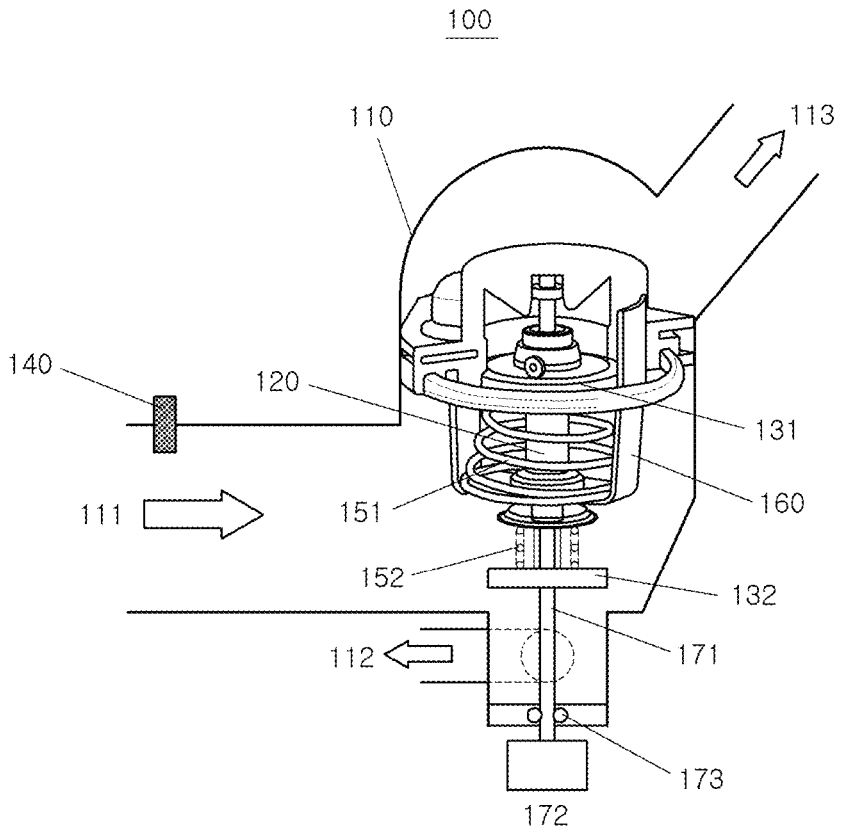
FIG. 3 is a schematic view of a thermostat for an engine cooling system according to an embodiment of the present disclosure.

FIG. 3 is a schematic view of a thermostat for an engine cooling system, such as the engine cooling system shown in FIG. 1, according to an embodiment of the present disclosure. Hereinafter, the thermostat for an engine cooling system according to the embodiment of the present disclosure will be described with reference to FIG. 3.

The thermostat 100 according to the embodiment of the present disclosure is arranged in a flow path between an engine (engine head and engine block) and a radiator of an engine cooling system as shown in FIG. 1. The thermostat 100 is configured such that a valve supported by a bracket 160 is operated by a change in the volume of wax 120 in a housing 110 of the thermostat. The valve in turn controls a flow path and a flow rate of the coolant.

The housing 110 is formed with a coolant inlet 111, a bypass outlet 112, and a radiator side outlet 113.

In addition, two valves, i.e., a main valve 131 and a bypass valve 132, are provided to control opening/closing and the flow rate of the radiator side outlet 113 and the bypass outlet 112, respectively.

The main valve 131 is arranged to open and close the radiator side outlet 113. Specifically, the main valve 131 is coupled to one side of the wax 120 in the bracket 160, i.e., a top side of the wax in the figure, so that it moves upward and downward in the figure by a change in the volume of the wax 120. The main valve 131 in turn opens and closes the radiator side outlet 113. After the main valve 131 changes position, the main valve is returned elastically to its original position by means of a main valve spring 151 supported on the bracket 160.

Further, the bypass valve 132 is arranged to open and close the bypass outlet 112. Specifically, the bypass valve 132 is coupled to the other side of the wax 120 in the bracket 160, i.e., a bottom side of the wax in the figure so that it moves upward and downward in the figure by a change in the volume of the wax 120. The bypass valve 132 in turn opens and closes the bypass outlet 112. After the bypass valve 132 changes the position, the bypass valve is returned elastically to its original position by means of a bypass valve spring 152 coupled to the bottom side of the bracket 160.

The thermostat 100 in this embodiment of the present disclosure is an electronic thermostat for controlling circulation of coolant to the bypass outlet 112 and the radiator side outlet 113 in response to operating conditions of the engine, such as load of the engine and environmental factors, by means of the main valve 131 and the bypass valve 132. To this end, the thermostat comprises a heating unit as a heat source for supplying heat to the wax 120.

The heating unit includes a heater 171 and a connector 172. In order to control the heater 171, a sensor 140 for detecting a temperature of the coolant is arranged at the coolant inlet 111 side.

Further, in this embodiment of the present disclosure, the heater 171 is coupled to the other side of the wax 171, i.e., the bottom side of the wax in the figure, rather than the radiator side outlet 113 that is the top side of the main valve 131, as in the conventional thermostat, and arranged through the bypass valve 132 and the housing 110.

In addition, the connector 172 provided outside the housing 110 is electrically connected to the heater 171 to control the heater 171. An O-ring 173 is provided between the housing 110 and the connector 172 as viewed in the section through the housing 110.

The heater 171 may be press-fit into a through-hole of the housing 110 without the O-ring 173. In addition, the heater may be integrally formed with the housing 110.

Consequently, in the embodiment of the present disclosure, the heater 171 does not decrease the flow rate of the coolant flowing to the radiator side outlet 113. In addition, since the heater is arranged at the bypass outlet 112 side, and thus the temperature of the coolant in the peripheral portion is low, it is advantageous in terms of temperature, sealing performance, and vibration. The reason for not decreasing the flow rate of the coolant is that the heater does not generate flow resistance.

Moreover, since the length of the heater 171 can be shortened compared to the conventional heater, it is simpler and more stable in terms of structure.

On the other hand, the bypass flow path (or bypass line) may not be required in the engine cooling system. In such a case, the thermostat according to embodiments of the present disclosure can be configured such that a bypass valve, a bypass valve spring, and a bypass outlet are omitted. In this case, the heater can be configured to be coupled to the connector outside the housing without the bypass valve, the bypass valve spring, and the bypass outlet.

Although the present disclosure has been described above with reference to the drawings illustrated by way of an example, the present disclosure is not limited to the disclosed embodiments. It should be apparent to those of ordinary skill in the art that various modifications and variations can be made to the present disclosure without departing from the spirit and scope of the disclosure. Therefore, such modifications or variations fall within the scope of the present disclosure as claimed and the scope of the present disclosure should be interpreted based on the appended claims.

What is claimed is:

1. A thermostat for an engine cooling system arranged between an engine and a radiator, the thermostat comprising:

a housing having a coolant inlet through which inflow coolant flows in from the engine, a radiator side outlet, and a bypass outlet to circulate the inflow coolant introduced through the coolant inlet to the engine;

a main valve supported by a bracket in the housing and coupled to a first side of a wax in the bracket to open and close the radiator side outlet by a change in a volume of the wax;

a bypass valve coupled to a second side of the wax in the bracket in the housing to open and close the bypass outlet; and a heating unit including a heater to heat the wax, wherein the heating unit is disposed adjacent to the bypass outlet such that a decrease of a flow rate of the coolant flowing to the radiator side outlet is avoided and a low temperature of the coolant flowing in a peripheral portion is maintained, wherein the heating unit further comprises a connector provided outside the housing and electrically connected to the heater to control the heater, and wherein a first end of the heater is coupled to the second side of the wax and is arranged through the bypass valve and a second end of the heater extends through the housing to the connector, the second end of the heater being further away from the radiator side outlet than the first end of the heater.

2. The thermostat according to claim 1, further comprising a sensor arranged at a side of the coolant inlet to detect a temperature of the inflow coolant.

3. The thermostat according to claim 1, wherein an O-ring is installed between the housing and the connector.

4. The thermostat according to claim 1, wherein the bypass valve provided in the housing is configured to open and close the bypass outlet by the change in the volume of the wax.

5. The thermostat according to claim 1, wherein the heater is press-fit into a through-hole of the housing.

6. The thermostat according to claim 1, wherein the heater is integrally formed with the housing.

7. The thermostat according to claim 1, further comprising a main valve spring to elastically support the main valve in the housing and return the main valve to its original position.

8. The thermostat according to claim 7, further comprising a bypass valve spring to elastically support the bypass valve in the housing and return the bypass valve to its original position.

* * * * *